US006279553B1

(12) United States Patent
Brueggemann et al.

(10) Patent No.: US 6,279,553 B1
(45) Date of Patent: Aug. 28, 2001

(54) VENTILATION DEVICE FOR A CRANKCASE OF AN INTERNAL COMBUSTION ENGINE

(75) Inventors: Hans Brueggemann, Winterbach; Hansjoerg Finkbeiner, Weilheim; Martin Schmid, Reichenbach, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/367,685

(22) PCT Filed: Feb. 11, 1998

(86) PCT No.: PCT/EP98/00756

§ 371 Date: Nov. 2, 1999

§ 102(e) Date: Nov. 2, 1999

(87) PCT Pub. No.: WO98/37316

PCT Pub. Date: Aug. 27, 1998

(30) Foreign Application Priority Data

Feb. 19, 1997 (DE) ..... 197 06 383

(51) Int. Cl.[7] ..... F01M 13/00; F02B 25/00

(52) U.S. Cl. ..... 123/572; 123/41.86; 123/192.2

(58) Field of Search ..... 123/572, 573, 123/574, 192.2, 90.34, 41.86, 196 R, 196 M; 74/603, 590

(56) References Cited

U.S. PATENT DOCUMENTS

| | | | | |
|---|---|---|---|---|
| 4,329,968 | | 5/1982 | Ishikawa et al. | 123/573 |
| 4,651,704 | | 3/1987 | Sekiguchi | 123/572 |
| 4,922,881 | * | 5/1990 | Tamba et al. | 123/572 |
| 5,261,380 | * | 11/1993 | Romano | 123/573 |
| 5,564,380 | | 10/1996 | Kobayashi et al. | 123/192.2 |
| 5,850,764 | * | 12/1998 | Bostelmann et al. | 74/603 |
| 5,947,068 | * | 9/1999 | Araki | 123/90.31 |

FOREIGN PATENT DOCUMENTS 2 094 273 2/1972 (FR) .

OTHER PUBLICATIONS

Poole, C.J. et al., "Cosworth MBA Engine", Inter. Congress and Exposition, Feb. 24, 1992, Detroit USA, pp. 1599–1610.

* cited by examiner

*Primary Examiner*—Noah P. Kamen
*Assistant Examiner*—Hai Huynh
(74) *Attorney, Agent, or Firm*—Crowell & Moring, L.L.P.

(57) ABSTRACT

A breathing device for a crankcase of an internal combustion engine, having a balancing shaft with mass-balancing weights. The breathing device is arranged in the cylinder head above the charge-cycle valves of the internal combustion engine and has at least one orifice for the inflow of gas, and a gas-guiding space which runs within the balancing shaft and which is connected to an intake system of the internal combustion engine. A space arranged outside the balancing shaft is connected to the crankcase. In order to reduce construction expenditures and to improve the degree of oil separation, at least one orifice is arranged in at least one of the mass-balancing weights. The orifice opens into at least one axially running feed bore connected to at least one oil-discharging radial bore in the mass-balancing weight. The radial bore communicates the space outside the balancing shaft with the gas-guiding space of the balancing shaft. Alternatively, the orifice may be arranged in the balancing shaft and open into the gas-guiding space which is connected to the intake system of the internal combustion engine and to oil-discharging radial bores which are defined in the mass-balancing weights and open into the space outside the balancing shaft.

13 Claims, 2 Drawing Sheets

VENTILATION DEVICE FOR A CRANKCASE OF AN INTERNAL COMBUSTION ENGINE

BACKGROUND AND SUMMARY OF THE INVENTION

This application claims the priority of German patent 197 06 383.7, filed Feb. 19, 1997, the disclosure of which is expressly incorporated by reference herein.

The invention relates to a breathing device for a crankcase of an internal combustion engine.

The SAE (Society of Automotive Engineers) Paper (February 1992) "Cosworth MBA Engine", Poole et al., page 8, discloses a generic breathing device for a crankcase of an internal combustion engine, in which, for oil separation, the blow-by oil mixture from the crankcase is guided into a housing in which a balancing shaft is mounted. The balancing shaft comprises a tubular piece with orifices, which forms a separation space and which is arranged between two balancing weights. The rotating balancing shaft likewise sets in rotation the blow-by oil mixture which has flowed out of the crankcase into the housing of the balancing shaft, the oil droplets contained in the blow-by gases being for the most part thrown against the outer wall of the balancing shaft and running off from the housing of the latter into the oil sump of the internal combustion engine. The pure blow-by gases pass via the orifices of the tubular piece into the separation space of the balancing shaft and from there into an intake system of the internal combustion engine. A relatively small proportion of the oil droplets nevertheless passes, together with the blow-by gases, into the separation space of the balancing shaft, is thrown against the inner wall of the tubular piece and passes again, via the orifices of the tubular piece, into the housing surrounding the balancing shaft, although the blow-by gases flowing through the same orifices into the balancing shaft may entrain again the oil droplets which have just emerged. Furthermore, the tubular piece used as the separation space constitutes an additional outlay in terms of the construction of the breathing device.

Reference is also made to U.S. Pat. Nos. 5,542,402 and 5,261,380 for the general technical background.

The object of the invention is to design a breathing device in such a way that, for a low outlay in terms of construction, the oil separation degree of the device is improved.

This object is achieved, according to the invention, by providing a breathing device for a crankcase of an internal combustion engine, comprising: a cylinder head defining a cylinder head space communicating with the crankcase of the internal combustion engine; a balancing shaft rotatably arranged in said cylinder head space, said balancing shaft defining a gas-guiding space communicating with an intake system of the internal combustion engine; at least one mass-balancing weight disposed on said balancing shaft, said at least one mass-balancing weight defining at least one oil discharging radial bore communicating said gas-guiding space with said cylinder head space, said at least one mass-balancing weight defining at least one axial feed bore communicating said cylinder head space with said at least one oil discharging radial bore.

An essential advantage of the breathing devices according to the invention is the increase in the oil separation rate. The spatial separation of the orifices for feeding the blow-by oil mixture into the mass-balancing weights, of the radial bores for the subsequent discharge of the oil droplets separated in the mass-balancing weights and of the gas-guiding space for discharging the blow-by gas into the intake system of the internal combustion engine prevents oil droplets which have already been separated from being entrained into the intake system. Due to the centrifugal forces acting on the blow-by oil mixture by virtue of the rotating balancing shaft, air and oil are positively separated from one another in the mass-balancing weights, air and oil being transferred through different bores after separation. There is no need for any additional outlay in terms of components, since the breathing device can be integrated into the balancing shaft and the mass-balancing weights. The machining outlay is low, since it is necessary only to introduce bores in the balancing shaft and the mass-balancing weights. An additional separation space can be dispensed with. The centrifugal force acting on the oil is substantially higher than the gravitational force likewise acting on the oil, so that the oil-discharging radial bores can be arranged at any desired location on the circumference of the mass-balancing weights and any inclined position of the internal combustion engine or vehicle still has no influence on oil separation.

Dimensioning the outflow resistance by reducing the diameter in the end region of the oil-discharging radial bores makes it possible to ensure that only oil emerges from the radial bores, but not the air.

Other objects, advantages and novel features of the present invention will become apparent from the following detailed description of the invention when considered in conjunction with the accompanying drawings.

DETAILED DESCRIPTION OF THE DRAWINGS

Figure 1:
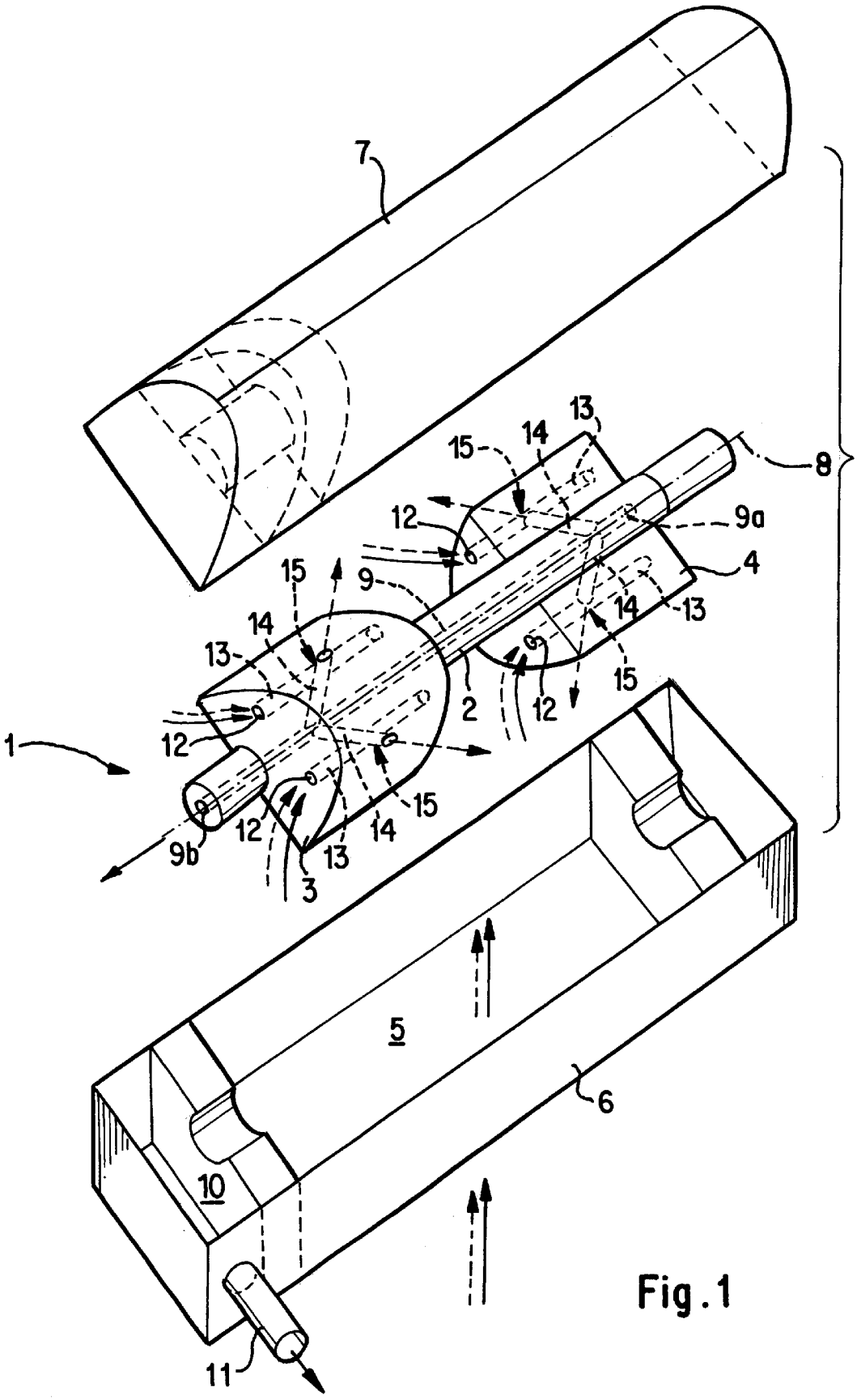
FIG. 1 is an exploded view of a breathing device according to the invention, with supply bores introduced in mass-balancing weights of a balancing shaft and with radial bores as well as with a gas-guiding space arranged in the balancing shaft, according to a first preferred embodiment.

The diagrammatic exploded drawing according to FIG. 1 shows an inventive breathing device 1 of a crankcase of an internal combustion engine. The combustion engine has a rotating balancing shaft 2 with mass-balancing weights 3 and 4, which is mounted in a space 5 in the cylinder head 6. The space 5 is communicated with the crankcase, above charge-cycle valves of the internal combustion engine which are not illustrated here. The space 5 is closed off upwards by a cover 7. The balancing shaft 2 has a gas-guiding space 9 which runs in the direction of the axis of rotation 8 of the balancing shaft and which is closed at one end 9*a* and at a gas-discharging end 9*b* is connected to the only partially illustrated intake system 11 of the internal combustion engine via a chamber 10 sealingly closed off outwards, with the result that a vacuum prevails in the breathing device 1.

Arranged in each case in the mass-balancing weights 3, 4 on their end faces are two orifices 12 which are located opposite one another and which open into feed bores 13 running axially and parallel to the axis of rotation 8 of the balancing shaft 2. The feed bores 13 are connected to radial bores 14 which are likewise introduced in the mass-balancing weights 3, 4 and which open into the space 5 outside the balancing shaft 2 and obliquely into the gas-guiding space 9 of the balancing shaft 2.

By virtue of the vacuum prevailing in the breathing device 1, the blow-by oil mixture emerging from the crankcase of the internal combustion engine passes, via the space 5 surrounding the balancing shaft 2, into the orifices 12 of the rotating mass-balancing weights 3 and 4 which are made in the end faces of the latter. The gas/oil mixture flows through the orifices 12 into the axially running feed bores 13 of the rotating mass-balancing weights 3 and 4. The centrifugal forces acting on the mixture cause the oil to be thrown off, the oil being separated on the walls of the feed bores 13. On account of the centrifugal forces acting on the oil, the separated oil passes via the radial bores 14 of the mass-balancing weights 3, 4 into the space 5 outside the balancing shaft 2 and drops off into the oil sump of the internal combustion engine. Since the balancing shaft 2, including the mass-balancing weights 3, 4 fastened to it, rotates about the axis of rotation 8 at a high rotational speed, it is impossible for the oil droplets, in contrast to the gases, to pass via the oil-discharging radial bores 14 into the gas-guiding space 9 within the balancing shaft 2. A reduction, not illustrated here, in the diameter of the end regions 15, facing the space 5 outside the balancing shaft 2, of the radial bores 14 and the associated increase in the outflow resistance make it possible, in addition, to ensure that only the separated oil, not the air, emerges into the space 5 outside the balancing shaft 2. By virtue of the vacuum prevailing in the breathing device 1, the blow-by gas follows a path through the radial bores 14 which is opposite to that of the oil and passes, via the gas-guiding space 9 and the adjoining flow-calming chamber 10 closed off in an air-tight manner relative to the surroundings, into the intake system 11 of the internal combustion engine. The path of the blow-by mixture is marked by arrows in FIGS. 1 and 2, the unbroken arrows marking the path of the air and the broken arrows the path of the oil.

Figure 2:
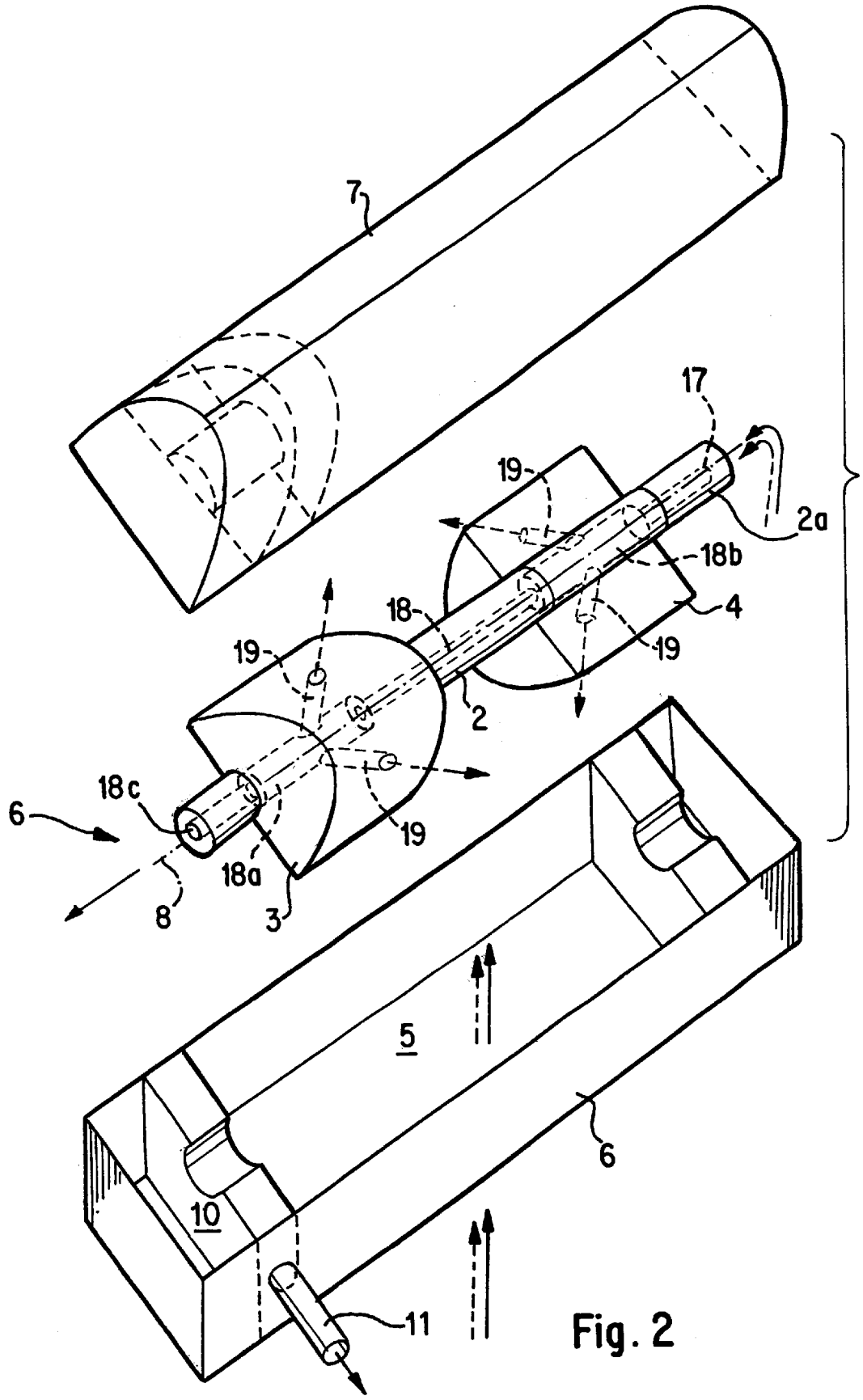
FIG. 2 is an exploded view of a breathing device according to the invention, with a gas-guiding space arranged in a balancing shaft and with radial bores introduced in mass-balancing weights of the balancing shaft, according to a second preferred embodiment.

FIG. 2 shows a diagrammatic exploded drawing of another preferred embodiment of a breathing device 16 according to the invention. For the sake of simplicity, the reference symbols used in FIG. 1 have been adopted for identical structural elements in FIG. 2. The balancing shaft 2 of the internal combustion engine has an orifice 17, made in its end face at one end 2*a*, for the inflow of the blow-by mixture from the crankcase, the orifice 17 opening into a gas-guiding space 18 which has separation spaces 18*a*, 18*b* within the mass-balancing weights 3, 4. In contrast to the first preferred embodiment, the mass-balancing weights 3, 4 have only oil-discharging radial bores 19 which communicate the gas-guiding space 18 of the balancing shaft 2 with the space 5 outside the balancing shaft 2. The gas-guiding space 18 of the balancing shaft 2 communicates with the intake system 11 of the internal combustion engine via the flow-calming chamber 10.

The blow-by mixture passes from the crankcase of the internal combustion engine, via the orifice 17 arranged in the end face of the balancing shaft 2 at the end 2*a* of the latter, into the gas-guiding space 18 and consequently into the separation spaces 18*a*, 18*b* of the balancing shaft 2 rotating about the axis of rotation 8. The centrifugal forces acting on the mixture as a result of the rotation of the balancing shaft 2 and of the mass-balancing weights 3, 4 cause the oil to be thrown out, via the radial bores 19 of the mass-balancing weight 3, 4, into the space 5 outside the balancing shaft 2, from which the oil drops off into the oil sump of the internal combustion engine. The blow-by gases are fed to the intake system 11 of the internal combustion engine via the chamber 10 which adjoins a gas-discharging end 18*c* of the gas-guiding space 18.

The number of mass-balancing weights used for the breathing device may vary, and therefore it is also contemplated to use only one mass-balancing weight. The chamber arranged between the intake system and breathing device allows optimum sealing-off, in that the chamber has, for example, a connection piece, integrally formed onto the chamber wall, for connection to the intake system, and the balancing shaft is mounted at its gas-discharging end in the chamber by means of a shaft-sealing ring. Furthermore, in both exemplary embodiments, oil separation can be adjusted by varying the position, diameters and angles of the radial and axial bores. In addition, the wetting area in the radial bores can be increased by the introduction of steel wool.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Breathing device for a crankcase of an internal combustion engine, comprising:

a cylinder head defining a cylinder head space communicating with the crankcase of the internal combustion engine;

a balancing shaft rotatably arranged in said cylinder head space, said balancing shaft defining a gas-guiding space communicating with an intake system of the internal combustion engine;

at least one mass-balancing weight disposed on said balancing shaft, said at least one mass-balancing weight defining at least one oil discharging radial bore communicating said gas-guiding space with said cylinder head space, said at least one mass-balancing weight defining at least one axial feed bore communicating said cylinder head space with said at least one oil discharging radial bore.

2. Breathing device according to claim 1, wherein said gas-guiding space communicates with said intake system via a chamber which is separate from said cylinder head space.

3. Breathing device according to claim 1, wherein each of said mass-balancing weights defines a pair of said axial feed bores, said pair of axial feed bores being located opposite one another relative to said balancing shaft.

4. Breathing device according to claim 1, wherein said at least one oil-discharging radial bore has a smaller diameter at a radially outer end communicating with said crankcase space.

5. Breathing device for a crankcase of an internal combustion engine, comprising:

a cylinder head defining a cylinder head space communicating with the crankcase of the internal combustion engine;

a balancing shaft rotatably arranged in said cylinder head space, said balancing shaft defining a gas-guiding space communicating the crankcase with an intake system of the internal combustion engine;

at least one mass-balancing weight disposed on said balancing shaft, said at least one mass-balancing weight defining at least one oil discharging radial bore for discharging oil separated from a blow-by mixture flowing through the gas-guiding space, the at least one oil discharging radial bore communicating said gas-guiding space with said cylinder head space.

6. Breathing device according to claim 5, wherein said gas-guiding space communicates with said intake system via a chamber which is separate from said cylinder head space.

7. Breathing device according to claim 5, wherein a portion of said gas-guiding space communicating with said at least one oil discharging radial bore is enlarged relative to a remaining portion of said gas-guiding space to form a separation space.

8. Breathing device for an internal combustion engine, comprising:

a cylinder head defining a cylinder head space;

a balancing shaft rotatably arranged in said cylinder head space, said balancing shaft defining a gas-guiding space communicating with an intake system of the internal combustion engine;

at least one mass-balancing weight disposed on said balancing shaft, said at least one mass-balancing weight defining at least one oil discharging radial bore communicating said gas-guiding space with said cylinder head space, one of said balancing shaft and said at least one mass-balancing weight defining at least one axial feed bore communicating said cylinder head space with said at least one oil discharging radial bore.

9. Breathing device according to claim 8, wherein said at least one mass-balancing weight defines said at least one axial feed bore.

10. Breathing device according to claim 8, wherein said balancing shaft defines said at least one axial feed bore.

11. Balancing shaft for an internal combustion engine, comprising:

a balancing shaft defining a gas-guiding space to be communicated with an intake system of the internal combustion engine;

at least one mass-balancing weight disposed on said balancing shaft, said at least one mass-balancing weight defining at least one oil discharging radial bore for communicating said gas-guiding space with a cylinder head space, one of said balancing shaft and said at least one mass-balancing weight defining at least one axial feed bore communicating said cylinder head space with said at least one oil discharging radial bore.

12. Balancing shaft according to claim 11, wherein said at least one mass-balancing weight defines said at least one axial feed bore.

13. Balancing shaft according to claim 11, wherein said balancing shaft defines said at least one axial feed bore.

* * * * *